US005712663A

United States Patent [19]

Matsumoto

[11] Patent Number: 5,712,663

[45] Date of Patent: Jan. 27, 1998

[54] APPARATUS FOR GENERATING A SPECIAL FONT CHARACTER BY USING NORMAL FONT CHARACTER DATA

[75] Inventor: Seiji Matsumoto, Hyogo, Japan

[73] Assignee: Mitsubishi Denki Kabushiki Kaisha, Tokyo, Japan

[21] Appl. No.: 440,609

[22] Filed: May 15, 1995

[30] Foreign Application Priority Data

Dec. 26, 1994 [JP] Japan ..... 6-323094

[51] Int. Cl.[6] ..... G09G 5/24

[52] U.S. Cl. ..... 345/195; 345/141; 345/192; 345/194; 345/197

[58] Field of Search ..... 345/141, 142, 345/143, 144, 192, 193, 194, 195, 197, 132; 395/150, 151, 100, 108, 110

[56] References Cited

U.S. PATENT DOCUMENTS

| | | | |
|---|---|---|---|
| H2 | 12/1985 | Soloway | 345/132 |
| 3,638,216 | 1/1972 | Brewster | 345/143 |
| 3,803,583 | 4/1974 | Manber | 345/143 |
| 4,602,880 | 7/1986 | Oba | 395/108 |
| 4,679,027 | 7/1987 | Higuchi | 345/141 |
| 4,715,006 | 12/1987 | Nagata | 395/110 |
| 4,808,985 | 2/1989 | Tanuma et al. | 345/197 |
| 4,907,172 | 3/1990 | Nishiyama | 345/141 |
| 5,367,634 | 11/1994 | Nakamura | 345/194 |
| 5,390,289 | 2/1995 | Beitel et al. | 395/100 |
| 5,500,653 | 3/1996 | Kamihata | 345/141 |

*Primary Examiner*—Richard Hjerpe
*Assistant Examiner*—Kent Chang
*Attorney, Agent, or Firm*—Lowe, Price, LeBlanc & Becker

[57] ABSTRACT

A character font generating apparatus comprising character ROM for storing font data of a character in a form of a plurality of horizontal lines each of which consists of a predetermined number of dots, a shift register with a data storing portion including the same number of flip-flops as the predetermined number, which stores data in parallel in response to a storing timing signal and outputs the stored data in serial in synchronization with a transfer clock signal, italic generation timing circuit for generating storing timing signals to be supplied to the shift register such that each of the storing timing signals is generated for each horizontal line of the font data stored in the character ROM on a different timing from timing of the other storing timing signals with respect to a time when a scan of a line is started, and display control circuit for controlling a data transfer from the character ROM to the shift register such that dot data of each horizontal line of a font data stored in the character ROM is transferred to the data storing portion of the shift register for storing the dot data into the storing portion in parallel based on a storing timing signal generated by the italics generation timing circuit.

6 Claims, 9 Drawing Sheets

VSYNC
HSYNC
OSCILLATING CIRCUIT
81
80
90
DISPLAY POSITION CONTROL CIRCUIT
DISPLAY CONTROL CIRCUIT
100
ITALICS GENERATION TIMING CIRCUIT
120
CHARACTER ROM
110
SHIFT REGISTER
130
FLIP FLOP
140
OUTPUT CIRCUIT
150
R G B OUT
R G B OUT
CRT CONTROL REGISTER
20
VERTICAL POSITION REGISTER
30
CHARACTER SIZE REGISTER
40
HORIZONTAL POSITION REGISTER
50
DISPLAY DATA RAM
60
CRT PORT CONTROL REGISTER
70
160
DATA BUS

FIG. 3 (a) SHIFT REGISTER TRANSFER CLOCK SIGNAL S C

FIG. 3 (b) SHIFT REGISTER STORING TIMING SIGNAL S T

FIG. 3 (c) DATA OUTPUT AT POINT a

FIG. 3 (d) DATA OUTPUT AT POINT b

SHIFT REGISTER
TRANSFER CLOCK SIGNAL S C

SIGNAL I N V OUTPUTTED
FROM CLOCKED INVERTER

SHIFT REGISTER
STORING TIMING
SIGNAL S T

NORMAL FONT

ITALIC FONT

A CASE WHERE LINES 1 AND 2 OF ITALIC CHARACTER ARE STORED

A CASE WHERE LINES 3 AND 4 OF ITALIC CHARACTER ARE STORED

A CASE WHERE LINES 13AND14 OF ITALIC CHARACTER OR ALL LINES OF NORMAL CHARACTER ARE STORED

APPARATUS FOR GENERATING A SPECIAL FONT CHARACTER BY USING NORMAL FONT CHARACTER DATA

BACKGROUND OF THE INVENTION

1. Field of the Invention

This invention relates to a image displaying apparatus which generates italic font character by using normal font character dot data which are stored in a character ROM.

2. Description of the Related Art

Recently, On Screen Display (OSD) function is built in many television receivers for displaying current channel, current level of volume on a screen. A user may change these parameters while viewing the parameters displayed on the screen. The OSD function is realized by a single-chip microcomputer used in a television receiver and is controlled by an image display unit. Further, at present, by utilizing the OSD function, not only channels and volume levels, but also operation procedures of the receiver or subtitles are displayed on a screen. Under these circumstances, the requirements for such an image display unit are becoming higher and more diverse. As one of the requirements is to display characters in italics.

FIG. 7 is a block diagram showing a conventional image displaying apparatus which generates italics font, described in Japanese Laid-Open Patent Application HEI 5-181447. In FIG. 7, reference numeral 16 denotes a data shift control circuit, 17 denotes a decoder, 1 denotes a readout address control circuit, 10 denotes a RAM for storing display data, 13 denotes a superimposing circuit, 14 denotes a shift register, 15 denotes a display control circuit.

FIG. 8(*a*) is a figure showing the character "A" in a normal font and FIG. 8(*b*) is a figure showing the character "A" in italics which is generated by the conventional apparatus of FIG.7.

A font selection bit signal S1 is outputted from the display data RAM 10 and inputted to the decoder 17. The font selection signal S1 is a signal which is outputted from the display data RAM 10 together with display mode data for each character such as character code data and color information data. This signal S1 indicates information whether a character is displayed in a normal font or in italics. The count value signal V1 is outputted from the readout address control circuit 1, indicating which horizontal line of a character is being read out. The signal V1 is inputted to the decoder 17 as well as the display control circuit 15.

FIGS. 9(*a*), 9(*b*), 9(*c*) show a configuration of shift register 14 and a way in which character data is stored into the shift register 14. The shift register 14 consists of serially connected 16 flip-flops 18*a*–18*p*. Further, the shift register 14 is constituted such that data may be transferred and stored in parallel to any consecutive flip-flops out of the 16 flip-flops 18*a*–18*p*. An italic font character is generated by varying a set of 10 flip-flops for storing horizontal line data depending on the order of the current horizontal line. The storing of the 10 dot horizontal line data is controlled by the data shift control circuit 16 based on the signal S2 from the decoder 17. When a character in a normal font is displayed, the output signal S2 becomes constant. As shown in FIG. 9(*c*), the storing position in the shift register 14 is the same regardless of the order of the current horizontal line of a character.

On the other hand, when a character in a italic font is displayed, the font selection bit signal S1 activates the decoder 17. For example, when a character should be shifted one dot for each two horizontal lines as shown in FIG. 8, the character dot data of 1st and 2nd horizontal lines are stored in the flip-flops 18*g*–18*p* of the shift register 14. The pieces of character dot data of 3rd and 4th horizontal lines are stored in the flip-flops 18*f*–18*o* of the shift register 14. As in the same way, the pieces of character dot data of the horizontal lines 5 and 6, 7 and 8, . . . , 13 and 14 are stored in the shift register 14, while shifting a position of the flip-flops thereby producing a character in italics as shown in FIG. 8(*b*).

SUMMARY OF THE INVENTION

The conventional character font generating apparatus is constituted as explained above and it is necessary for the apparatus to have a shift register having larger number of bits than a number of dots of a horizontal line of a character. This is one of the reasons for the difficulty in making the size of the apparatus smaller. Further, in the conventional apparatus, the movement of dot data of one horizontal line is performed with a precision corresponding to a cycle of a transfer clock signal for a shift register.

Therefore, an object of the invention is to provide a character font generating apparatus which generates a special character font from the normal character font data without storing special character font data in the apparatus with a smaller size and with a high precision.

In order to accomplish the above object, the character font generating apparatus comprising means for storing font data of a character in a form of a plurality of horizontal lines each of which consists of a predetermined number of dots; a shift register including a data storing portion with an area of the same number of bits as the predetermined number, which stores data in parallel in response to a storing timing signal and which outputs the stored data in serial in synchronization with a transfer clock signal; means for generating storing timing signals to be supplied to the shift register such that each of the storing timing signals is generated for each horizontal line of the font data stored in the font data storing means on a different timing from the other storing timing signals with respect to a time when a scan of a line is started; and means for controlling a data transfer from the font data storing means to the shift register such that dot data of each horizontal line of a font data stored in the font data storing means is transferred to the data storing portion of the shift register for storing the dot data into the storing portion in parallel based on a storing timing signal generated by the storing timing signals generating means.

Therefore, a special character font may be produced by using a shift register having the area of storing only the dot data of one line of a character. This contributes to making a lighter and smaller apparatus.

Further, in the character font generating apparatus of this invention, the font data stored in the font data storing means is a normal font character data, the storing timing signals generating means generates storing timing signals to be outputted to the shift register such that a storing timing signal for a later horizontal line is generated earlier with respect to a time when a scan of a horizontal line is started, and the shift register outputs an italic character data corresponding to the normal font character data.

Therefore, an italic font may be produced by using a shift register having the area of storing only the dot data of one line of a character. This contributes to making a lighter and smaller apparatus.

Further, in the character font generating apparatus of this invention, the storing timing signals generating means generates storing timing signals to be supplied to the shift register for all the horizontal lines on a constant timing with respect to a time at which a scan of a horizontal line is started when a font selection signal indicative of normal font is inputted to the storing timing signals generating means and the storing timing signals generating means generates storing timing signals to be supplied to the shift register such that a storing timing signal for a later horizontal line is generated earlier with respect to a time at which a scan of a horizontal line is started when a font selection signal indicative of italic font is inputted to the storing timing signals generating means.

Therefore, a font may be selected between an italic font and normal font by storing only the data of normal font character.

Further, in the character font generating apparatus of this invention, the storing timing signals generating means generates storing timing signals with a precision corresponding to half a cycle of the transfer clock signal by using timing of leading edges and trailing edges of the transfer clock signal.

Therefore, a more smooth character font may be obtained and displayed.

DETAILED DESCRIPTION OF THE PREFERRED EMBODIMENTS

Embodiment 1

The first embodiment of the invention will be explained in detail with reference to the figures.

Figure 1:
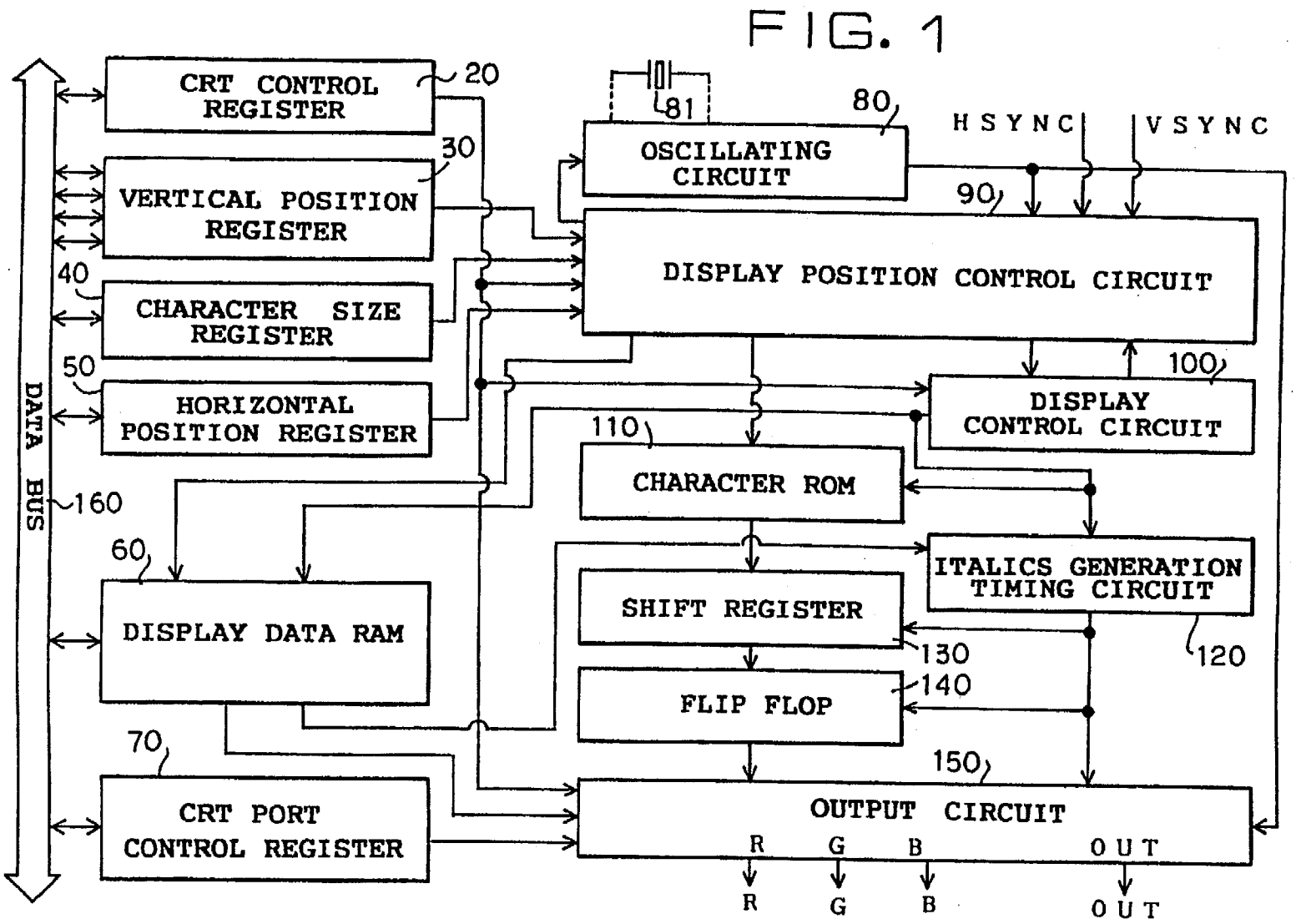
FIG. 1 is a block diagram showing the constitution of the image display apparatus of the first embodiment of this invention by using a single-chip microcomputer.

FIG. 1 is a block diagram showing the constitution of the image display apparatus of this invention by using a single-chip microcomputer. In this figure, reference numeral 20 denotes a CRT control register, 30 denotes a vertical position register, 40 denotes a character size register, 50 denotes a horizontal position register, 60 denotes a display data RAM, 70 denotes a CRT port control register, 80 denotes an oscillating circuit, 90 denotes a display position control circuit, 100 denotes a display control circuit, 110 denotes a character ROM, 120 denotes an italics generation timing circuit, 130 denotes a shift register, 140 denotes a flip flop, 150 denotes an output circuit.

The horizontal synchronization signal HSYNC and the vertical synchronization signal VSYNC are supplied to the display position control circuit 90. An external crystal oscillator 81 is connected to the oscillating circuit 80 which oscillates at a certain frequency while the circuit is being reset by each vertical synchronization signal VSYNC. The crystal oscillator 81 may be replaced by a ceramic oscillator. The output signal from the oscillating circuit 80 is used as a reference clock for a display which is supplied to the display position control circuit 90 and the output circuit 150.

The data for displaying a desired character or a pattern is inputted to the display data RAM 60 and the registers 20, 30, 40, 50, 70 via the data bus 160 in accordance with instructions from a CPU whose description is omitted from the FIG. 1. The data stored in the CRT control register 20 is supplied to the display control circuit 100 and the output circuit 150 for controlling ON/OFF of character display. The pieces of data corresponding to vertical position and horizontal position at the time of starting a character display are inputted to the vertical position register 30 and the horizontal position register 50, respectively. The data corresponding to a size of a character to be displayed is inputted to the character size register 40. The pieces of data stored in these registers 30, 40, and 50 are supplied to the display position control circuit 90. RGB (Red, Green, Blue) signals are outputted from the output circuit 150 based on the values of data stored in the CRT port control register 70. The display data RAM 60 includes character code data, color code data, attribute data indicating characteristics of characters.

A value of data stored in the horizontal position register 30 is compared with a counted number of the horizontal synchronization signals HSYNC in the display position control circuit 90. Then, a value of data stored in the horizontal position register 50 is compared with a counted number of a display clock outputted from the oscillating circuit 80. As a result of the comparisons, when the values in the registers 30 and 50 coincides with the counted values, respectively, the display position control circuit 90 sends a display permission signal to the display control circuit 100. Responsively to the display permission signal, the display control circuit 100 is activated, thereby the count number of horizontal synchronization signal HSYNC is supplied to the display data RAM 60 and then the character code data from the display data RAM 60 is inputted to the character ROM 110 in the order in which the corresponding characters are displayed. The color code data and the attribute data are supplied to the output circuit 150. On the other hand, the character codes are decoded by referencing the character ROM 110 and each line data of a normal font character data corresponding to the character code data is sent to the shift register 130 where each line data is stored in parallel. The data from the display control circuit 100 for generating a character in italics is supplied to the italics generation timing circuit 120 regularly.

Figure 2:
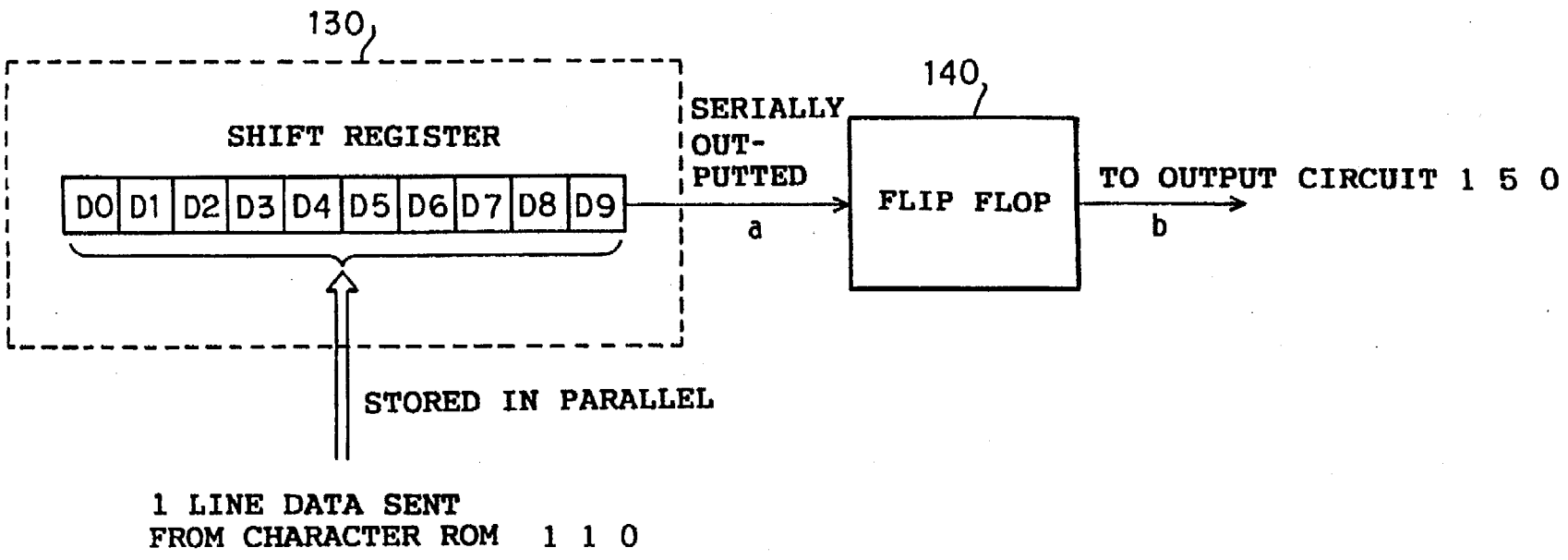
FIG. 2 is a block diagram showing a constitution of the shift register shown in FIG. 1.

FIG. 2 is a block diagram showing a constitution of the shift register 130. As shown in this figure, the shift register 130 includes ten flip-flops D0–D9, which are serially connected with each other. One line data from the character ROM 110 is stored into these flip-flops D0–D9 in parallel. The data stored in the shift register 130 is supplied to the flip-flop 140 by a bit-by-bit basis in synchronization with a shift register transfer clock provided by the italics generation timing circuit 120.

Figure 3:
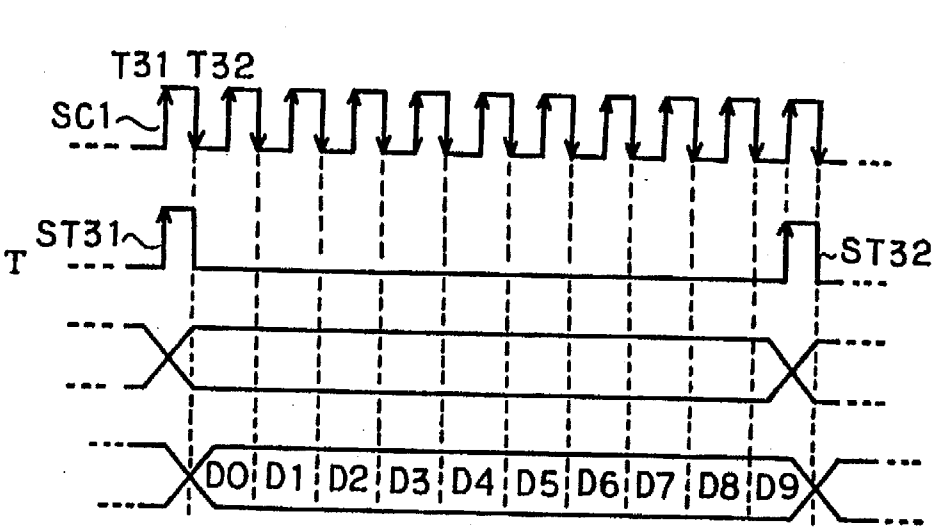
FIGS. 3(*a*)–3(*d*) are timing charts showing input or output signals of the shift register shown in FIG. 2.

FIGS. 3(*a*)–3(*d*) are timing charts which show an operation of the shift register 130. FIG. 3(*a*) shows a shift register transfer clock signal. SC. FIG. 3(*b*) shows a shift register storing timing signal ST which shows timing of storing one line data from the character ROM 110 into the shift register 130 in parallel. FIG. 3(*c*) shows data outputted at the point a in FIG. 2. FIG. 3(*d*) shows data outputted at the point b in FIG. 2. As shown in FIGS. 3(*a*)–3(*d*), the shift register 130 performs a shift operation at the leading edge T31 of the shift register transfer clock SC and the flip-flop 140 performs a latch operation at the trailing edge T32.

In this embodiment, the shift register storing timing signal ST is generated at a leading edge of the shift register transfer clock signal SC. The pulse ST32 of the shift register storing timing signal ST is subsequently generated at the tenth trailing edge of the shift register transfer clock signal SC for storing subsequent line data into shift register 130 from the pulse ST31 of the shift register storing timing signal ST generated at the italics generation timing circuit 120 because a number of dots in horizontal direction of a character is 10.

Next, the operation of generating a normal font character will be explained. When the font selection signal indicative of normal font from the display data RAM 60 is sent to the italics generation timing circuit 120, each one line data is stored into the shift register 130 at the constant timing from the start of scanning each line regardless of the order of the horizontal line. After the storing of one line data (10 dots data) is finished, the one line data is sent in serial to the flip-flop 140 in synchronization with leading edges of the shift register transfer clock signal SC outputted from the italics generation timing circuit 120. The data outputted to the flip-flop 140 is latched at the timing of a trailing edge of the shift register transfer clock signal SC and is outputted to the output circuit 150 in sequence. In accordance with color code data and attribute data sent from the display data RAM 60, the output circuit 150 performs coloring and attribute processing to a normal font character and resultant RGB signals are outputted accordingly.

Figure 4:
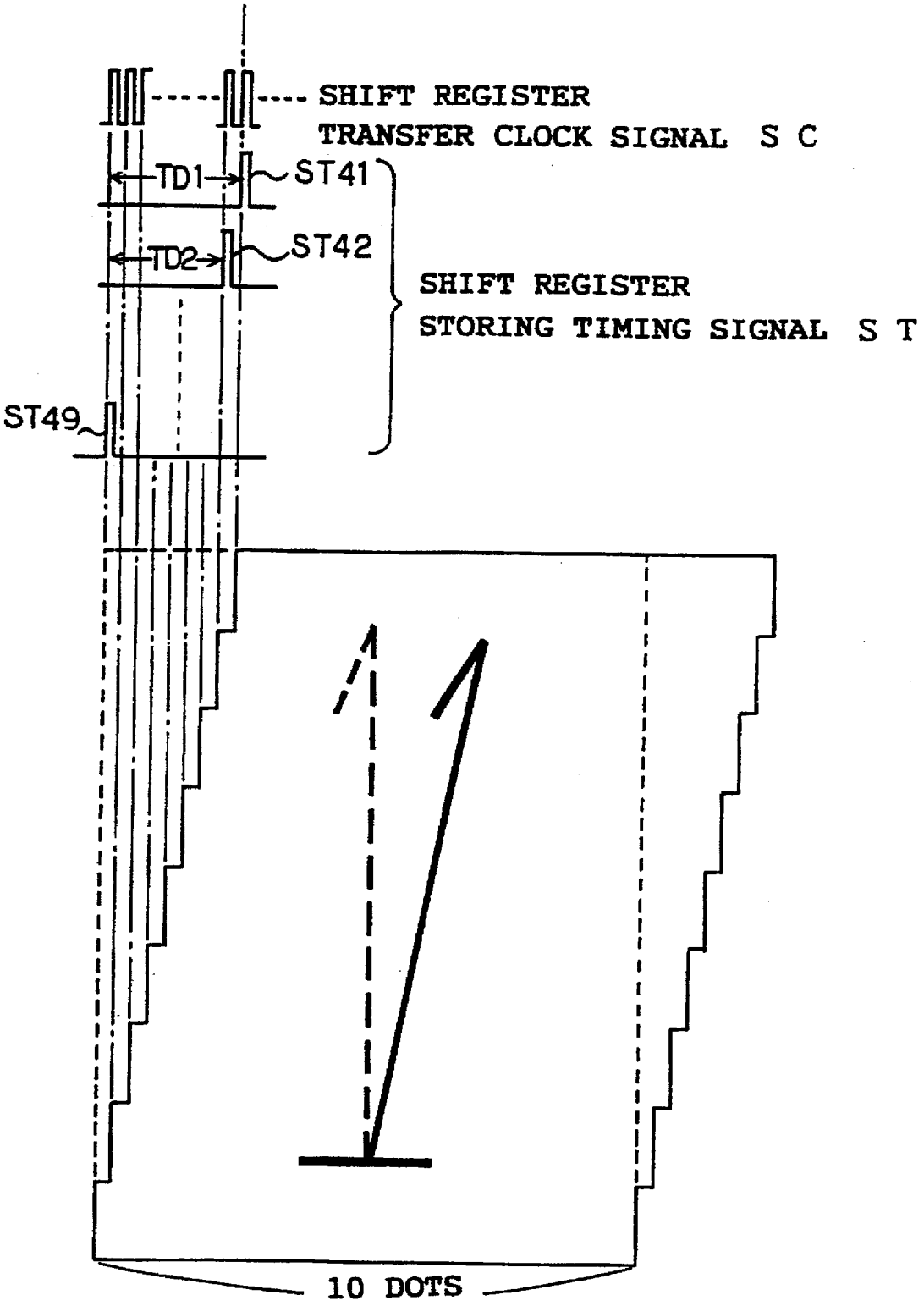
FIG. 4 is a drawing explaining the operation of generating italic character in the first embodiment.

Next, the operation of generating a character in italics will be explained. FIG. 4 shows shift register transfer clock SC, shift register storing timing signal ST for each horizontal line, character "1" in italics obtained by changing the timing of storing one line data into the shift register in sequence.

When a font selection signal indicative of italics from the display data RAM 60 is inputted to the italics generation timing circuit 120, the italics generation timing circuit 120 produces shift register storing timing signals whose timings are different from each other based on shift register storing timing data sent from the display control circuit 100. These produced shift register storing timing signals are supplied to the shift register 130. Namely, as shown in FIG. 4. the shift register storing timing pulse ST41 for the first line is produced after the time period TD1 elapses from the first transfer clock pulse in synchronization with a leading edge of the shift register transfer clock. Next, the shift register storing timing pulse ST42 for the second line is produced after the time period TD2 elapses from the first transfer clock pulse in synchronization with a leading edge of the shift register transfer clock. Similarly to the above, shift register storing timing pulses for the lines after the second lines are produced such that a shift register storing timing pulse is produced gradually earlier for a later horizontal line.

The data of 10 dots of each line is stored into the shift register 130 in parallel in synchronization with a leading edge of the produced shift register storing timing signal ST. The stored data is shifted in synchronization with a leading edge of the shift register transfer clock SC. The flip-flop 140 latches inputted data in synchronization with a trailing edge of the shift register transfer clock signal SC. As stated above, data for a character in italics is sent to the output circuit 150 by making the timing of storing data into the shift register earlier for a later horizontal line. In accordance with color code data and attribute data sent from the display data RAM 60, the output circuit 150 performs coloring and attribute processing to the italic font character and resultant RGB signals are outputted accordingly.

In this embodiment, a character in italics is generated by advancing the timing of storing data into the shift register by one line, however, italic character may be produced by advancing the timing of storing data into the shift register by a plurality of lines. Further, a character in a font other than italics may be generated by advancing and delaying the timing of storing data into the shift register, and by changing the amount of the period to be advanced or to be delayed by one line or plurality of lines.

Embodiment 2

The second embodiment of the invention will be explained with reference to the figures. In the above embodiment, the data is stored into the shift register in synchronization with a leading edge of the shift register transfer clock signal SC. That is, the precision of the horizontal movement for one line is defined by one cycle of the shift register transfer clock signal SC. However, in this embodiment, the precision of the horizontal movement for one line may be doubled. the constitution of the image display apparatus of this embodiment is the same as that shown in FIG. 1 except for the italics generation timing circuit 120*a* and duplicate explanation is omitted.

Figure 5:
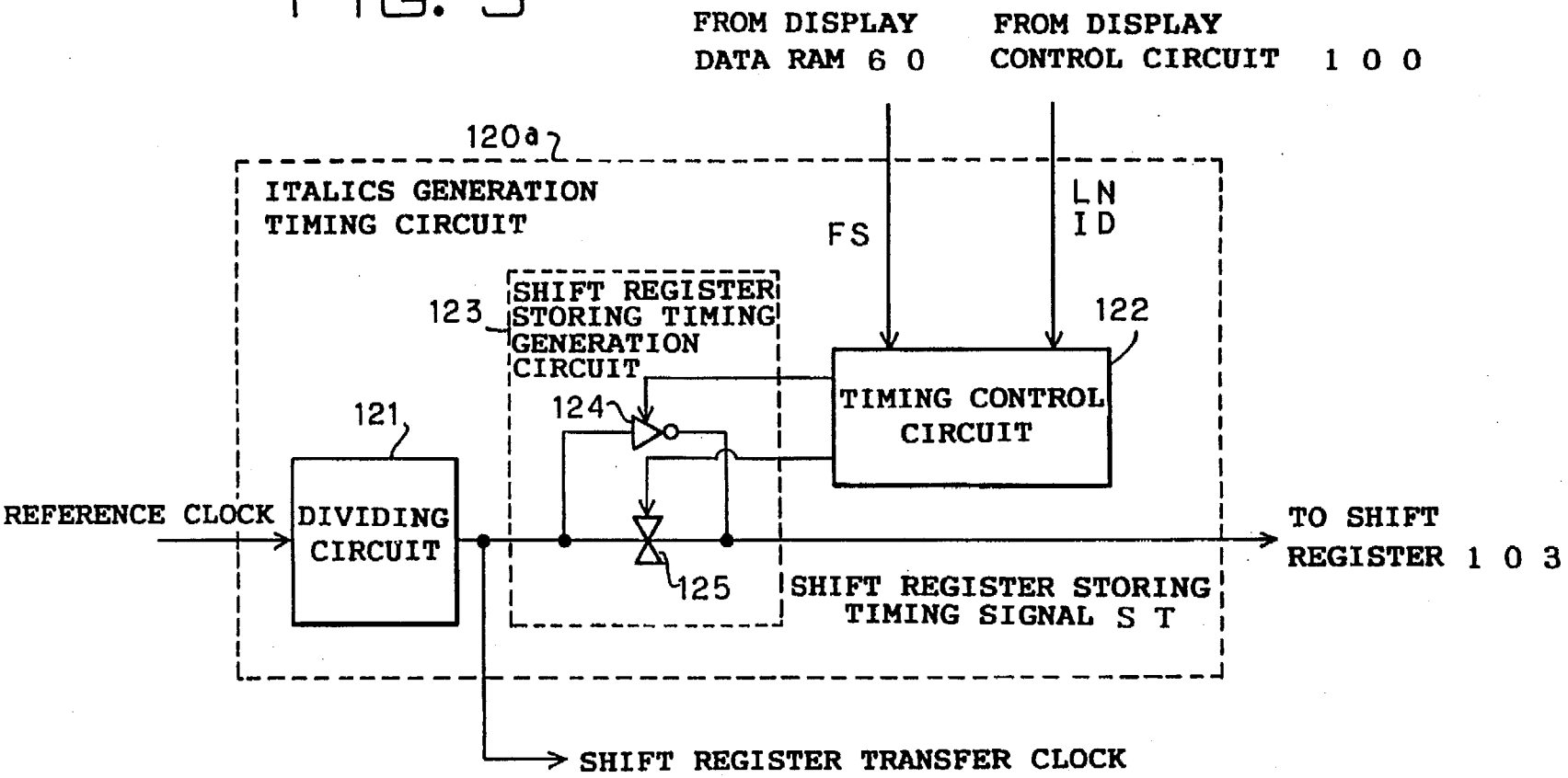
FIG. 5 is a circuit diagram of the italics generation timing circuit in the second embodiment.

FIG. 5 is a circuit diagram of an italics generation timing circuit 120*a* of this embodiment. As shown in this figure, the italics generation timing circuit 120*a* includes the dividing circuit 121 which produces the shift register transfer clock SC with 50 percent duty ratio and with half a frequency of the reference clock, the shift register storing timing generation circuit 123 which generates the shift register storing timing signal ST, and the timing control circuit 122 which controls the shift register storing timing generation circuit 123. The shift register storing timing generation circuit 123 includes the transmission gate 125 and the clocked inverter 124 connected in parallel to the transmission gate 125. The font selection signal FS from the display data RAM 60 is inputted to the timing control circuit 122. The line signal LN indicating which line is being displayed and the data ID for generating an italic character are transferred from the display control circuit 100 to the timing control circuit 122.

Next, the operation of displaying a normal font character will be explained. In this case, the timing control circuit 122 keeps the clocked inverter 124 off continuously. Then, the timing control circuit 122 produces a shift register storing timing signal by making the transmission gate 125 on during one clock cycle period at the constant timing from the start of scanning lines for each of the lines. The produced shift register storing timing signal is supplied to the shift register 130.

Figure 6:
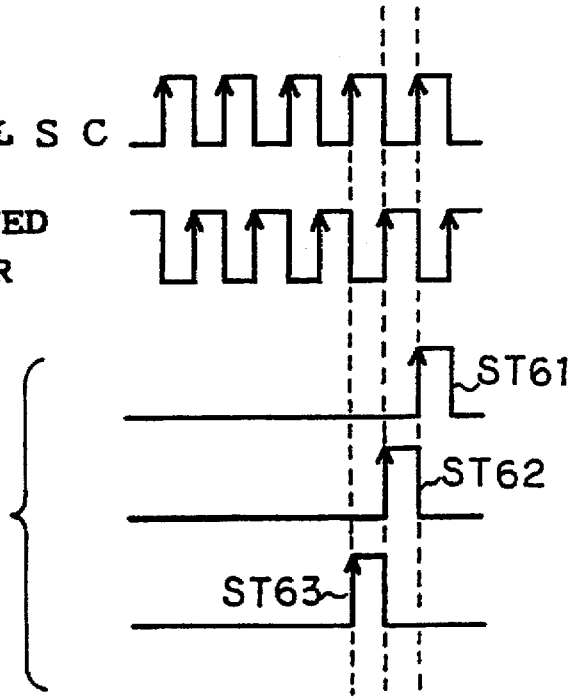
FIGS. 6(*a*)–6(*c*) are timing charts for explaining the operation of displaying an italic character in the second embodiment.
Figure 7:
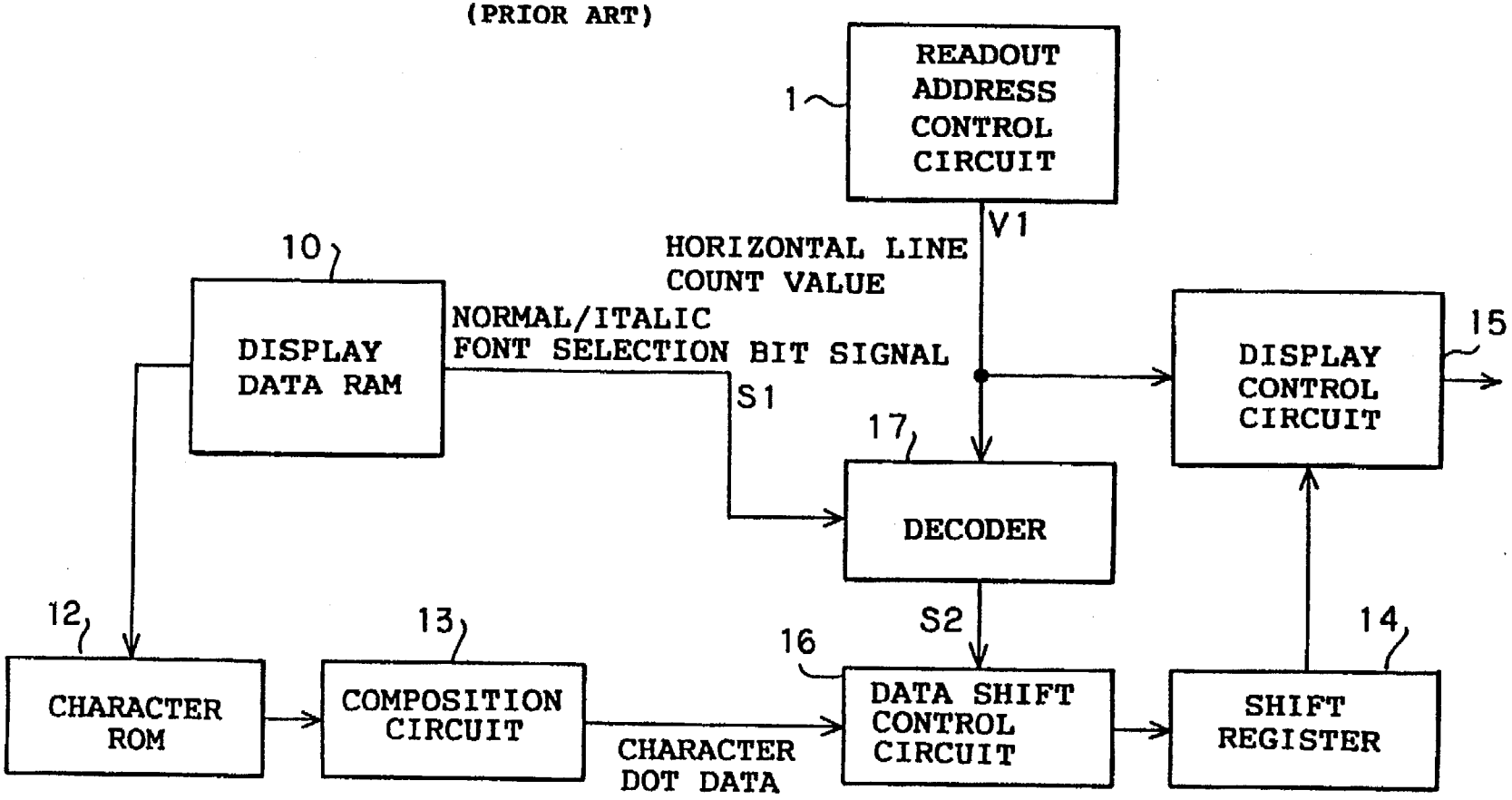
FIG. 7 (PRIOR ART)
FIG. 7 is a block diagram showing a constitution of a conventional character font generating apparatus which generates an italic character.
Figure 8A:
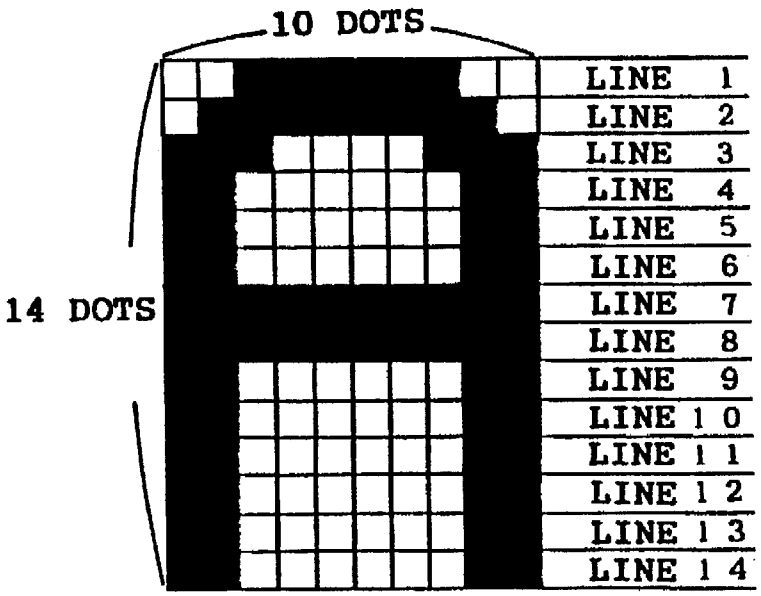
FIG. 8(a) (PRIOR ART)
FIGS. 8(*a*), 8(*b*) are a figure showing the character "A" in a normal font and a figure showing the character "A" in italics which is generated by the conventional apparatus of FIG. 7, respectively.
Figure 8B:
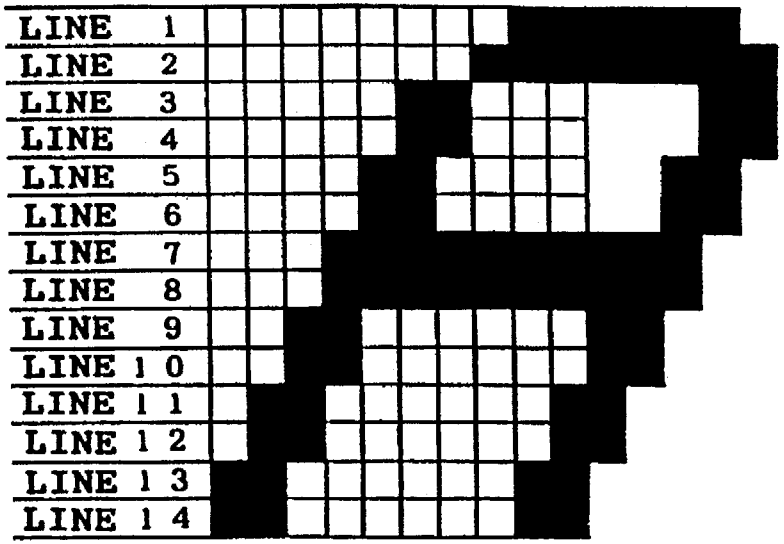
FIG. 8(b) (PRIOR ART)
Figures 9A, 9B, 9C:
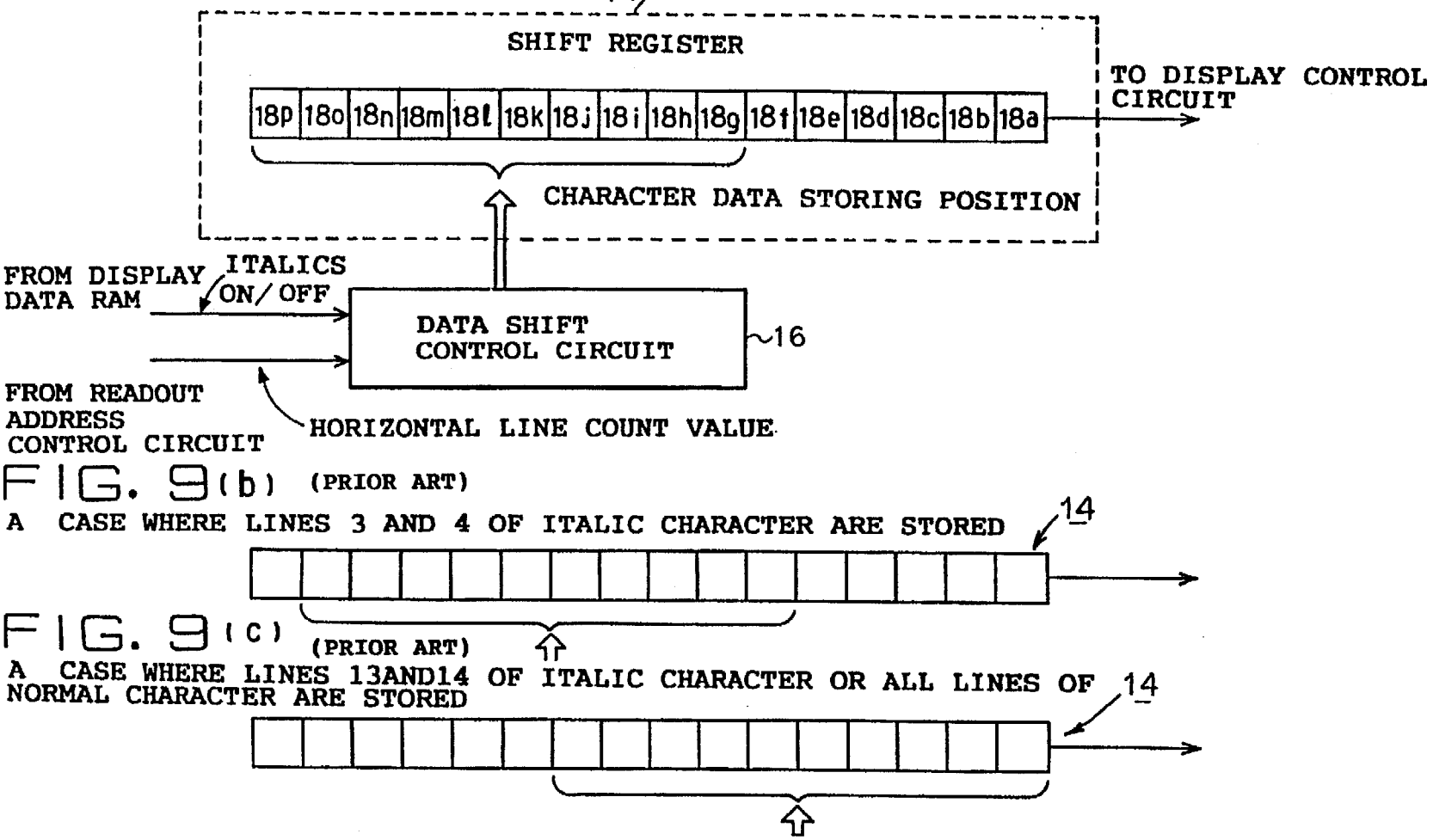
FIG. 9(a) (PRIOR ART)
FIG. 9(b) (PRIOR ART)
FIG. 9(c) (PRIOR ART)
FIGS. 9(*a*), 9(*b*), 9(*c*) show a configuration of shift register and a way in which character data is stored into the shift register.

Next, the operation of displaying an italic character will be explained. FIGS. 6(*a*)–6(*c*) show the timing charts of the signals shift register transfer clock SC, signal INV outputted from the clocked inverter 124 and shift register storing timing signal ST, respectively.

As shown in FIG. 6, for the first line of a character, the timing control circuit 122 keeps the clocked inverter 124 off continuously and keeps the transmission gate 125 on during a predetermined period after a certain time period elapses from the start of scanning the line, thereby the pulse ST61 of the shift register storing timing signal ST is generated. For the second line, the timing control circuit 122 keeps the transmission gate 125 off continuously and keeps the transmission gate 125 on during a predetermined period after a certain time period elapses from the start of scanning the line, thereby the pulse ST62 of the shift register storing timing signal ST is generated. In this case, the timing control circuit 122 controls the shift register storing timing generation circuit 123 such that the pulse ST62 is generated earlier than the pulse ST61. For the third line, the timing control circuit 122 keeps the clocked inverter 124 off continuously and keeps the transmission gate 125 on during a predetermined period after a certain time period elapses from the start of scanning the line, thereby the pulse ST63 of the shift register storing timing signal ST is generated. In this case, the timing control circuit 122 controls the shift register storing timing generation circuit 123 such that the pulse ST63 is generated earlier than the pulse ST62. Similarly to the above, for the other lines, the timing control circuit 122 controls the shift register storing timing generation circuit 123 such that pulses of the shift register storing timing signal ST are generated gradually earlier with respect to the start of the scanning a line. The operations after the shift register storing timing signal ST is supplied to the shift register 130 are the same as those of the first embodiment and the duplicate explanation is omitted.

As explained above, in this embodiment, a shift register storing timing signal ST may be prepared on the timing of half a cycle of the shift register transfer clock signal SC. Namely, the precision of the horizontal movement in one line may be twice as high as that of the first embodiment, thereby more smooth italic character may be produced.

Similarly to the first embodiment, an italic character may be produced by advancing the timing of storing data into the shift register by a plurality of lines. Further, a character in a font other than italics may be generated by advancing and delaying the timing of storing data into the shift register, and by changing the amount of the period to be advanced or to be delayed by one line or plurality of lines. Especially in the second embodiment, movement of dots in one line may be set more precisely. Therefore, the apparatus of this embodiment is suitable for preparing a character in a special font other than italics as well.

What is claimed is:

1. An apparatus for generating a character font, comprising:

means for storing font data of a character in a form of a plurality of horizontal lines each of which consists of a predetermined number of dots;

a single shift register, including a data storing portion with an area of the same number of bits as the predetermined number, which stores data in parallel in response to a storing timing signal and which outputs the stored data in serial in synchronization with a transfer clock signal;

means for generating a plurality of storing timing signals to be supplied to the single shift register such that each one of the plurality of storing timing signals is generated for a corresponding horizontal line of the font data stored in the font data storing means on a different timing from the other storing timing signals with respect to a time when a scan of a line is started with a precision corresponding to half a cycle of the transfer clock signal by using timing of leading edges and trailing edges of the transfer clock signal; and means for controlling a data transfer from the font data storing means to the single shift register such that dot data of each horizontal line of a font data stored in the font data storing means is transferred to the data storing portion of the single shift register for storing the dot data into the storing portion in parallel based on the corresponding storing timing signal generated by the storing timing signals generating means.

2. An apparatus according to claim 1, wherein the font data stored in the font data storing means is a normal font character data, wherein the storing timing signals generating means generates the plurality of storing timing signals to be outputted to the single shift register such that a storing timing signal for a later horizontal line is generated earlier with respect to a time when a scan of a horizontal line is started, and wherein the single shift register outputs an italic character data corresponding to the normal font character data.

3. An apparatus according to claim 2, wherein the storing timing signals generating means generates the plurality of storing timing signals to be supplied to the single shift register for all the horizontal lines on a constant timing with respect to a time at which a scan of a horizontal line is started when a font selection signal indicative of normal font is inputted to the storing timing signals generating means, and wherein the storing timing signals generating means generates the plurality of storing timing signals to be supplied to the single shift register such that a storing timing signal for a later horizontal line is generated earlier with respect to a time at which a scan of a horizontal line is started when a font selection signal indicative of italic font is inputted to the storing timing signals generating means.

4. An apparatus for generating a character font, comprising:

means for storing font data of a character in a form of a plurality of horizontal lines each of which consists of a predetermined number of dots;

a shift register, including a data storing portion with an area of the same number of bits as the predetermined number, which stores data in parallel in response to a storing timing signal and which outputs the stored data in serial in synchronization with a transfer clock signal;

means for generating a plurality of storing timing signals to be supplied to the shift register such that each one of the plurality of storing timing signals is generated for a corresponding horizontal line of the font data stored in the font data storing means on a different timing from the other storing timing signals with respect to a time when a scan of a line is started with a precision corresponding to half a cycle of the transfer clock signal by using timing of leading edges and trailing edges of the transfer clock signal; and means for controlling a data transfer from the font data storing means to the shift register such that dot data of each horizontal line of a font data stored in the font data storing means is transferred to the data storing portion of the shift register for storing the dot data into the storing portion in parallel based on the corresponding storing timing signal generated by the storing timing signals generating means.

5. An apparatus according to claim 4, wherein the font data stored in the font data storing means is a normal font character data, wherein the storing timing signals generating means generates the plurality of storing timing signals to be outputted to the shift register such that a storing timing signal for a later horizontal line is generated earlier with respect to a time when a scan of a horizontal line is started, and wherein the shift register outputs an italic character data corresponding to the normal font character data.

6. An apparatus according to claim 5, wherein the storing timing signals generating means generates the plurality of storing timing signals to be supplied to the shift register for all the horizontal lines on a constant timing with respect to a time at which a scan of a horizontal line is started when a font selection signal indicative of normal font is inputted to the storing timing signals generating means, and wherein the storing timing signals generating means generates the plurality of storing timing signals to be supplied to the shift register such that a storing timing signal for a later horizontal line is generated earlier with respect to a time at which a scan of a horizontal line is started when a font selection signal indicative of italic font is inputted to the storing timing signals generating means.

* * * * *